US008156913B2

(12) United States Patent
Schlicker et al.

(10) Patent No.: US 8,156,913 B2
(45) Date of Patent: Apr. 17, 2012

(54) POLYPHENYLENE SULFIDE SLEEVE IN A NYLON COOLANT CROSS-OVER OF AN AIR INTAKE MANIFOLD

(75) Inventors: Scott C. Schlicker, Ferndale, MI (US); Raymond J. Ballou, Jr., Milford, MI (US); James R. Wareham, Bartlesville, OK (US); Thomas L. Giovannetti, Owasso, OK (US); Rick Kunc, Bartlesville, OK (US); Sandra K. McClelland, Sterling Height, MI (US)

(73) Assignees: BASF SE, Ludwigshafen (DE); Chevron Phillips Chemical Company LP, The Woodlands, TX (US)

( * ) Notice: Subject to any disclaimer, the term of this patent is extended or adjusted under 35 U.S.C. 154(b) by 512 days.

(21) Appl. No.: 12/175,537

(22) Filed: Jul. 18, 2008

(65) Prior Publication Data

US 2009/0038574 A1 Feb. 12, 2009

Related U.S. Application Data

(60) Provisional application No. 60/950,345, filed on Jul. 18, 2007.

(51) Int. Cl.
*F02M 35/10* (2006.01)

(52) U.S. Cl. ..... 123/184.61

(58) Field of Classification Search ..... 123/41.01, 123/184.21, 184.32, 41.79, 41.74, 184.34, 123/184.55, 184.61; 525/132, 151, 133, 525/69; *F02M 35/10*
See application file for complete search history.

(56) References Cited

U.S. PATENT DOCUMENTS

| | | | | |
|---|---|---|---|---|
| 3,383,435 | A * | 5/1968 | Cizek | 525/132 |
| 3,730,147 | A | 5/1973 | Buchwald | |
| 3,931,811 | A | 1/1976 | McFarland, Jr. | |
| 4,072,133 | A | 2/1978 | McWhirter | |
| 4,267,812 | A | 5/1981 | Aula et al. | |
| 4,279,224 | A * | 7/1981 | Szabo et al. | 123/184.32 |
| 4,872,424 | A | 10/1989 | Carnes | |
| 5,016,578 | A | 5/1991 | Ogawa et al. | |
| 5,127,371 | A | 7/1992 | Ogawa et al. | |
| 5,477,819 | A | 12/1995 | Kopec | |
| 5,544,629 | A | 8/1996 | Ohata et al. | |
| 5,655,492 | A | 8/1997 | Sattler et al. | |

(Continued)

OTHER PUBLICATIONS

PCT International Search Report for PCT/US2008/008794 dated Dec. 15, 2008, 3 pages.

*Primary Examiner* — Noah Kamen
*Assistant Examiner* — Keith Coleman
(74) *Attorney, Agent, or Firm* — Howard & Howard Attorneys PLLC

(57) ABSTRACT

The subject invention provides a coolant cross-over for circulating an engine coolant between a first engine component, e.g., a first cylinder head, and a second engine component, e.g., a second cylinder head. The coolant cross-over defines a first outlet in fluid communication with the first engine component, a second outlet in fluid communication with second engine component, and further defines a passage interconnecting the first outlet and the second outlet. The coolant cross-over comprises a polymer. A sleeve comprises polyaromatic sulfide and is disposed within the passage for separating the engine coolant from the nylon which forms the coolant cross-over to prevent physical, thermal and/or chemical degradation of the polymeric coolant cross-over by the engine coolant.

26 Claims, 3 Drawing Sheets

U.S. PATENT DOCUMENTS

| | | | | |
|---|---|---|---|---|
| 5,704,325 | A | 1/1998 | Sattler et al. | |
| 5,762,036 | A | 6/1998 | Verkleeren | |
| 6,192,849 | B1 | 2/2001 | Powell | |
| 6,446,585 | B1 | 9/2002 | Coffey et al. | |
| 6,553,954 | B1 | 4/2003 | Slonecker | |
| 6,679,215 | B2 | 1/2004 | Benson et al. | |
| 6,840,204 | B1 | 1/2005 | Brassell | |
| 6,945,199 | B2 * | 9/2005 | Kapala et al. | 123/41.01 |
| 2003/0101957 | A1 | 6/2003 | Benson et al. | |
| 2003/0221651 | A1 | 12/2003 | Ito et al. | |
| 2003/0226535 | A1 | 12/2003 | Pietrowski et al. | |
| 2004/0231628 | A1 | 11/2004 | Jones et al. | |
| 2005/0061266 | A1 | 3/2005 | Kapala et al. | |

* cited by examiner

POLYPHENYLENE SULFIDE SLEEVE IN A NYLON COOLANT CROSS-OVER OF AN AIR INTAKE MANIFOLD

CROSS REFERENCE TO RELATED APPLICATION

This application claims the benefit of U.S. Provisional Patent Application Ser. No. 60/950,345, filed on Jul. 18, 2007, the disclosure of which is hereby incorporated by reference.

BACKGROUND OF THE INVENTION

1. Field of the Invention

The subject invention generally relates to an air intake manifold for supplying air to a plurality of cylinders in an engine.

2. Description of the Related Art

Air intake manifolds supply a flow of an air or air/fuel mixture to the cylinders of an engine for combustion. The air intake manifold is typically mounted to a cylinder head of the engine, and defines a plurality of runners in fluid communication with the cylinders of the engine.

In a V-style engine, the air intake manifold is attached to a first cylinder head and a second cylinder head of the engine. As part of an engine coolant system, an engine coolant is circulated through a plurality of water-jackets in the engine and in each of the first and second cylinder heads. The engine coolant system further includes a coolant cross-over interconnecting the first and second cylinder heads in fluid communication. Frequently, the air intake manifold and the coolant cross-over are integrally formed from a metal, such as aluminum.

U.S. Pat. No. 3,931,811 (the '811 patent) discloses such a metal air intake manifold. The air intake manifold disclosed in the '811 patent is for use in a V-style engine and includes the coolant cross-over integrally formed with the metal air intake manifold for interconnecting fluid passageways in the first and second cylinder heads of the engine. Casting and milling operations are utilized to produce the metal air intake manifold. However, metal air intake manifolds are costly to produce because of both material costs of the metal as well as production costs associated with the casting and milling operations necessary to produce the metal air intake manifold. Additionally, it is desirable to minimize a weight of the air intake manifold to reduce an overall weight of a vehicle to thereby increase a fuel efficiency of the vehicle.

As a cost saving measure and to reduce the weight of the air intake manifold, manufacturers began producing the air intake manifold from a polymer, such as nylon 6, or nylon 6/6. While the polymer air intake manifold requires a lower cost to produce and weighs less than the metal air intake manifold, the engine coolant degrades the polymer material forming the air intake manifold. Accordingly, the polymer air intake manifolds do not include an integrally formed coolant cross-over.

U.S. Pat. No. 6,945,199 (the '199 patent) discloses an air intake manifold formed from a polymer material, which includes a coolant cross-over. The coolant cross-over is formed from a metal to prevent degradation by the engine coolant, and is mechanically attached to the polymer air intake manifold. While the '199 patent permits the use of polymer air intake manifolds, which reduced the overall cost and weight of the air intake manifold, there are still significant costs associated with the casting and milling operations necessary to produce the coolant cross-over from metal and attach the metal coolant cross-over to the polymer air intake manifold.

Accordingly, there remains a need for a coolant cross-over that is formed from a polymer, is resistant to degradation, reduces the overall weight of the air intake manifold, reduces the cost of producing the air intake manifold and reduces the number of manufacturing operations necessary to produce the air intake manifold.

SUMMARY OF THE INVENTION AND ADVANTAGES

The subject invention provides an air intake manifold for supplying air to a plurality of cylinders in an engine. The manifold comprises a body, a coolant cross-over, and a sleeve. The body defines a plurality of runners for directing the air to the cylinders. The coolant cross-over extends from the body, and defines a first outlet, a second outlet and a passage interconnecting the first outlet and the second outlet. The passage circulates an engine coolant between the first outlet and the second outlet. The coolant cross-over is formed from a polymer. The sleeve comprises a polyaromatic sulfide and is disposed within the passage for separating the engine coolant and the polymer which forms the coolant cross-over to prevent degradation of the polymer by the engine coolant.

Accordingly, the sleeve comprising the polyaromatic sulfide permits the coolant cross-over to be produced from a polymer (e.g., nylon), while allowing the polymeric coolant cross-over to be resistant to physical degradation, thermal degradation, and/or chemical degradation (e.g., hydrolysis) by the engine coolant. Producing the coolant cross-over from the polymer reduces a cost of producing the coolant cross-over and decreases the weight of the coolant cross-over, thereby helping to increase a fuel efficiency of a vehicle by lowering the overall weight of the vehicle.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF A PREFERRED EMBODIMENT OF THE INVENTION

Figure 1:
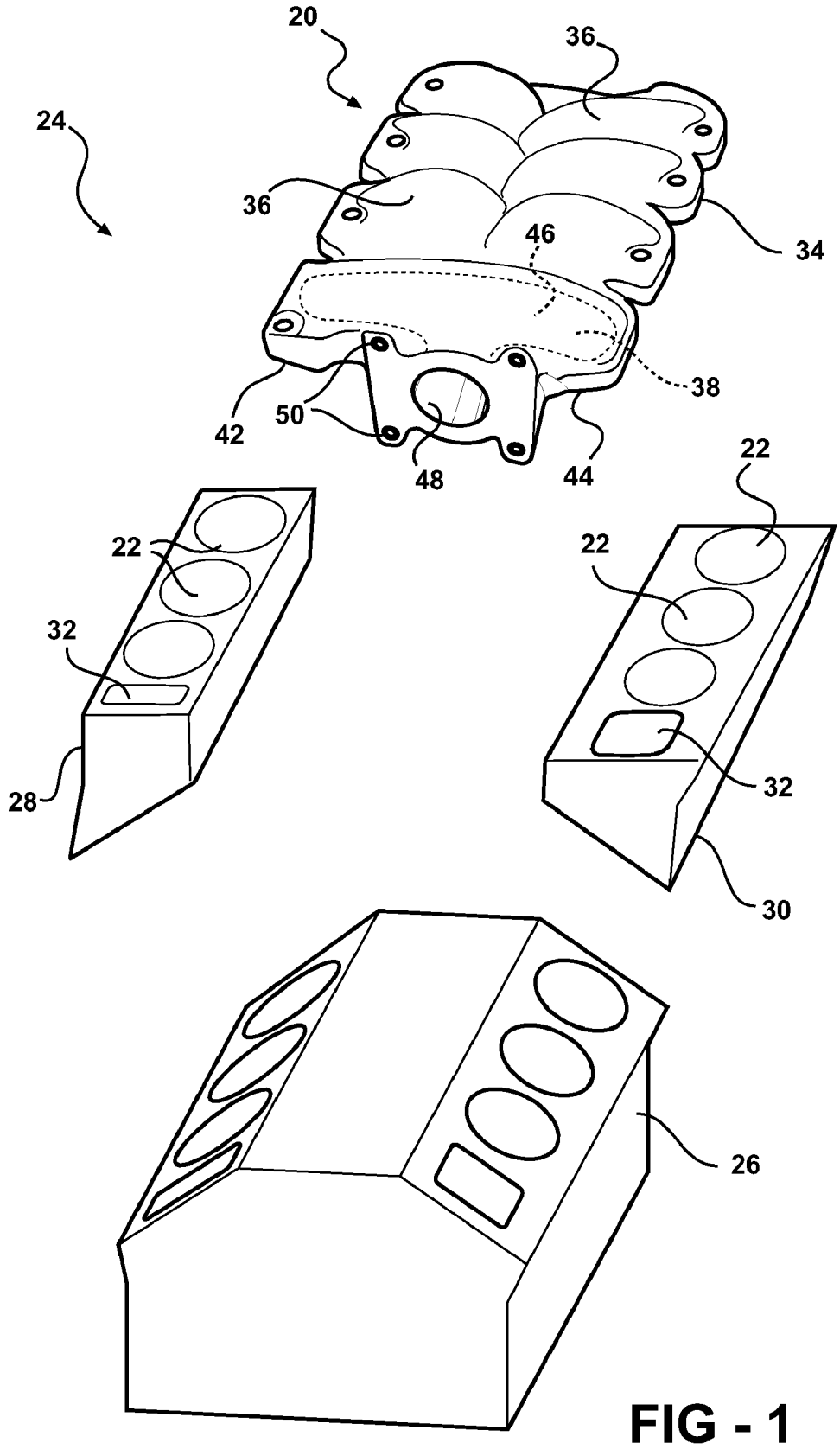
FIG. 1 is an exploded perspective view of a V-type engine, a first cylinder head, a second cylinder head, and an air intake manifold having a coolant cross-over.
Figure 2:
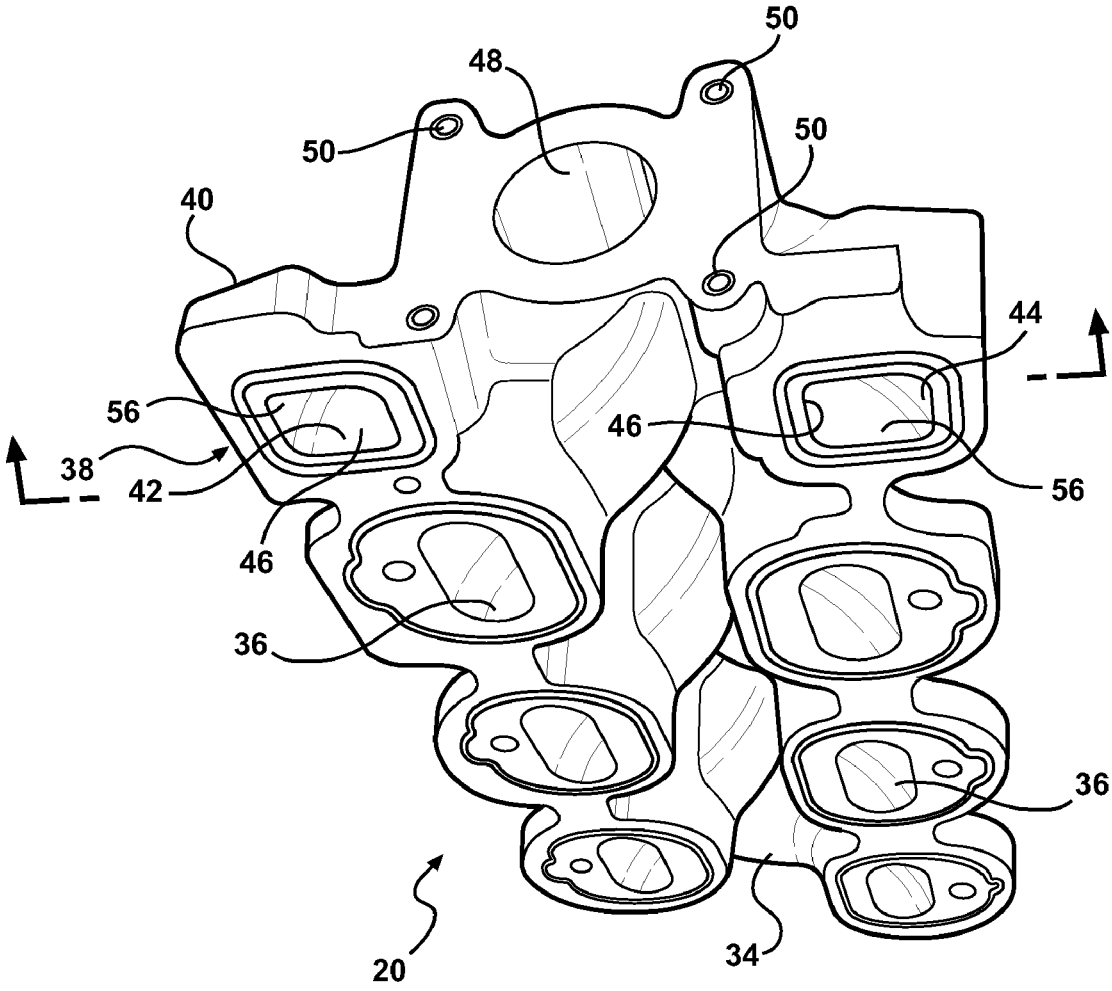
FIG. 2 is a perspective view of the coolant cross-over integrally formed with the coolant cross-over from a nylon.
Figure 3:
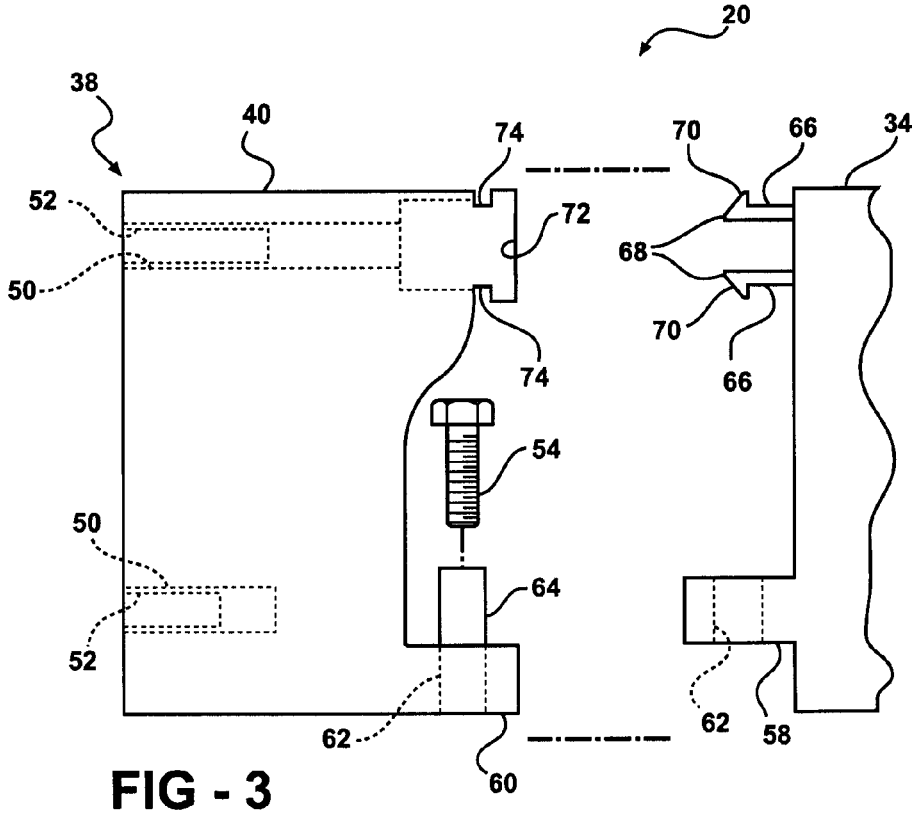
FIG. 3 is an exploded side view of the air intake manifold showing a separate plastic or nylon body of the air intake manifold and the coolant cross-over.
Figure 4:
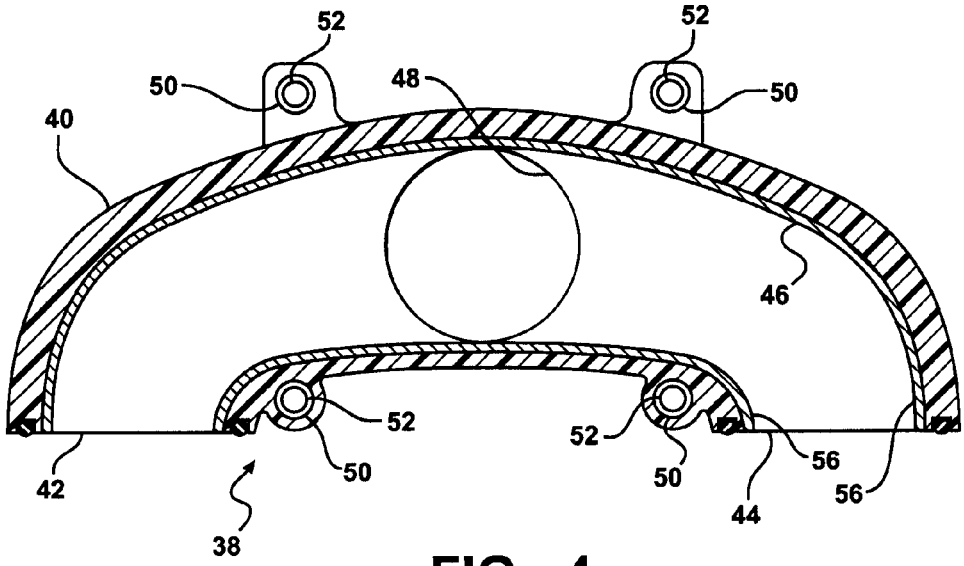
FIG. 4 is a cross sectional view of the coolant cross-over cut along line 4-4 shown in FIG. 2.

In an aspect, the invention relates to a coolant cross-over for an internal combustion engine. The coolant cross-over may include a sleeve comprising a polyaromatic sulfide to separate the coolant cross-over from an engine coolant. The invention also relates to an air intake manifold for an internal combustion engine that incorporates the coolant cross-over. The invention further relates to an engine(s) incorporating the disclosed air intake manifold and/or coolant cross-over and a vehicle(s) incorporating an engine utilizing the disclosed air intake manifold and/or coolant cross-over.

Compositionally, the air intake manifold may comprise a polymer. Additionally, the coolant cross-over of the air intake manifold may also comprise a polymer. In an embodiment, the air intake manifold and the coolant cross-over may comprise the same polymer. Alternatively, the air intake manifold and the coolant cross-over may comprise different polymers. In some embodiments, the polymer forming the air intake manifold and/or the coolant cross-over may comprise a polyamide, more preferably a nylon. Examples of suitable nylons which may comprise the air intake manifold and/or the coolant cross-over may include, but are not limited to, a nylon 6, a nylon 6/6, or mixtures thereof. In the context of the present invention, it is to be understood the polymer (e.g. a nylon, nylon 6 or nylon 6/6) can be a neat, i.e., virgin, uncompounded resin, or the polymer can be an engineered product where the resin is compounded with other components, for example with select additives to improve certain physical properties. Examples of suitable polymers include, but are not limited to, Ultramid® polyamides commercially available from BASF Corporation.

It should also be understood that in some embodiments the air intake manifold and/or the coolant cross-over may alternatively comprise a polyaromatic sulfide such as polyphenylene sulfide and/or a polyphenylene sulfide alloy, and may also comprise a metal, such as aluminum.

The polyaromatic sulfide utilized for the sleeve and optionally utilized for the intake manifold and the coolant cross-over may be neat, i.e., virgin, uncompounded resin, or an engineered product where the polyaromatic sulfide is compounded with other components, (e.g. compounded with filler or other polymers to improve certain physical properties such as thermal resistance and chemical resistance). These other compounds may include, but are not limited to, polyphenylene sulfide sulfone, polyphenylene sulfide ketone, polyphenylene sulfide ether, polydiphenylene sulfide, and combinations thereof.

The polyaromatic sulfide of the instant invention typically includes the self-polymerization product of an aromatic sulfide. The aromatic sulfide includes an aromatic moiety and a sulfide moiety. The aromatic moiety is typically selected from the group of benzene, naphthalene, anthracene, pyridine, pyrrole, furan, thiophene, cyclopentadiene, cyclobutadiene, purine, pyrimidine, cycloheptatriene, cyclopropene, and combinations thereof. It is to be appreciated that the aromatic moiety is not limited to those described immediately above and may include any known in the art. Most preferably, the aromatic moiety is benzene. Typically, the polyaromatic sulfide is produced through nucleophilic substitution of di-halo aromatics, such as chloro- and halo-benzenes, with metal sulfides, such as sodium sulfide, in organic solvents such as N-methylpyrrolidone. However, it is to be understood that the polyaromatic sulfide is not limited to formation by such reactions and may be formed by any means in the art.

In one embodiment, the polyaromatic sulfide includes polyphenylene sulfide. The polyphenylene sulfide may include poly(p-phenylene sulfide), poly(o-phenylene sulfide), poly(m-phenylene sulfide), and combinations thereof. For descriptive purposes only, the chemical structures of poly (p-phenylene sulfide), poly(o-phenylene sulfide), and poly (m-phenylene sulfide) are shown below:

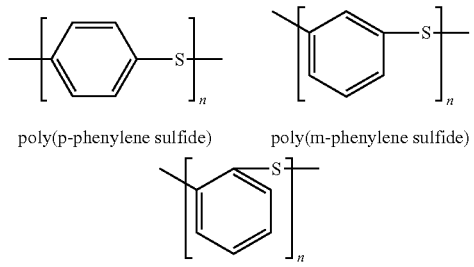

wherein n is a number of greater than 1.

In another embodiment, the polyaromatic sulfide consists essentially of poly(p-phenylene sulfide) and does not include any other sulfides that materially affect the basic and novel characteristic(s) of this invention. In yet another embodiment, the polyaromatic sulfide consists of poly(p-phenylene sulfide).

Generally, polyphenylene sulfide comprises at least 70 mole, or alternatively 90 mole %, of para-phenylene sulfide units, i.e., (p-phenylene sulfide) units. The structure of a single para-phenylene sulfide unit is set forth below:

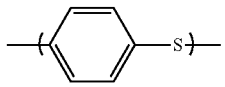

Polyphenylene sulfide may comprise up to 30 mole %, or alternatively up to 10 mole %, of recurring units represented by one or more of the following structural formulas:

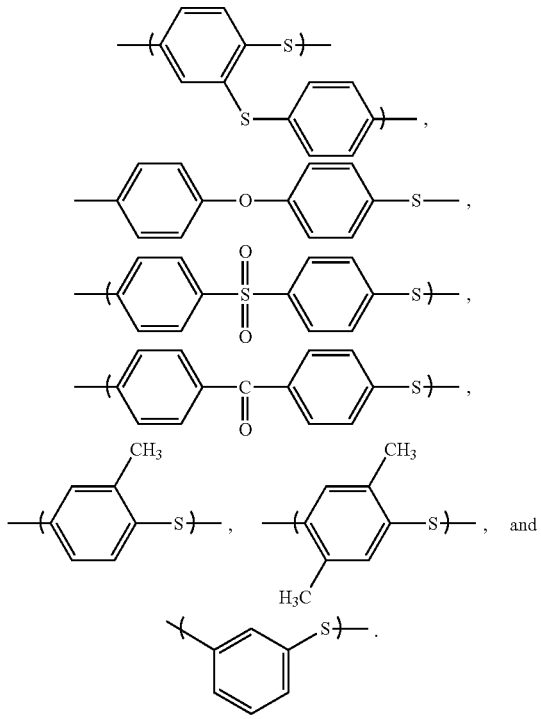

Polyphenylene sulfide is manufactured and sold under the trade name Ryton® polyphenylene sulfide by Chevron Phillips Chemical Company LP of The Woodlands, Tex. Other sources of polyphenylene sulfide include Ticona, Toray, and Dainippon Ink and Chemicals, Incorporated, among others. Polyphenylene sulfide may be blended or compounded with various additives to provide desired properties. Polyphenylene sulfide may be may be heated, melted, extruded, and molded into desired shapes and composites in a variety of processes, equipment, and operations. The polyphenylene sulfide may be subjected to heat, compounding, injection molding, blow molding, precision molding, film-blowing, extrusion, and so forth.

The polyphenylene sulfide may include a polyphenylene sulfide alloy. In general, the polyphenylene sulfide or the polyphenylene sulfide alloy, is corrosion resistant and has particular application in high temperature environments, such as the high temperatures commonly associated with operation of an engine. The polyphenylene sulfide may be a 'regular' polyphenylene sulfide, i.e., a linear polymeric material, may be a 'cured' polyphenylene sulfide, i.e., a polyphenylene sulfide which results from curing (heating) of the polyphenylene sulfide in the presence of oxygen, may be an 'HMW linear' polyphenylene sulfide, i.e., a polyphenylene sulfide having a molecular weight approximately double that of regular polyphenylene sulfide, may be an 'HMW branched' polyphenylene sulfide, i.e., a polyphenylene sulfide having a molecular weight higher than that of regular polyphenylene sulfide also where a backbone of the extended molecule has additional polymer chains branched from it, or may be a 'glass reinforced' polyphenylene sulfide compound, i.e., a polyphenylene sulfide combined with glass fibers. Suitable polyphenylene sulfides are commercially available from Chevron Phillips Chemical Company LP of The Woodlands, Tex., under the trade name Ryton®. Additionally, suitable polyphenylene sulfide alloys are commercially available under the trade name Xtel®, also from Chevron Phillips Chemical Company LP.

The polyphenylene sulfide or the polyphenylene sulfide alloy may be filled or unfilled. Suitable fillers which may be utilized include, but are not limited to, an aluminum hydroxide, an aluminum oxide, an antimony oxide, an aluminum silicate, a barium sulfate, a calcium carbonate, a calcium magnesium carbonate, calcium magnesium aluminum silicate processed mineral fibers, a calcium silicate, a calcium sulfate, carbon blacks, glass beads or hollow spheres, a graphite, an iron oxide, a magnesium hydroxide, a magnesium oxide, a magnesium silicate, a mica, a montmorillonite, a silica, a soapstone, a titanium dioxide, a zeolite, or a zinc oxide. It should be understood that other fillers may also be utilized.

The polyphenylene sulfide alloy typically comprises polyphenylene sulfide and at least one other material. The at least one other material of the polyphenylene sulfide alloy may include any thermoplastic or thermoset material. For example, the polyphenylene sulfide alloy may comprise a polyolefin homopolymer. Alternatively, a polyolefin copolymer may be used. High density polyethylene, low density polyethylene, linear low density polyethylene, medium density polyethylene, polypropylene, polystyrene, or a polystyrene butadiene copolymer may be used either singularly, or in any combination, to form the polyphenylene sulfide alloy. Any material compatible with polyphenylene sulfide may be used and is not limited to polymers or polyolefins. In such alloys, at least 50 weight percent of the polymer content is typically polyphenylene sulfide. It should be noted that the air intake manifold and/or the coolant cross-over comprising polyphenylene sulfide include those comprising a polyphenylene sulfide alloy.

The air intake manifold may comprise a composition having a polymer content of from about 30% to about 70% by weight of the polymer composition and a content of the filler of form about 70% to about 30% by weight of the polymer composition.

In particular instances the coolant cross-over may be susceptible to physical, thermal, and/or chemical degradation by contact with the engine coolant. For example, nylon, which may be used to form the coolant cross-over, is susceptible to chemical degradation (e.g. hydrolysis) by contact with engine coolant. The sleeve functions to protect the coolant cross-over from physical, thermal, and/or chemical degradation by the engine coolant. In particular embodiments, the sleeve protects the polymeric coolant cross-over from physical degradation, thermal degradation, and/or chemical degradation. In particular embodiments, the sleeve may protect a nylon coolant cross-over from chemical degradation (e.g. hydrolysis) by limiting contact of the nylon with the engine coolant.

The sleeve may comprise any polymer which is resistant to physical, thermal, or chemical degradation due to contact with the engine coolant. In a particular embodiment, the coolant cross-over sleeve may comprise polyphenylene sulfide; or alternatively, a polyphenylene sulfide alloy.

In an embodiment, the coolant cross-over may comprise a polymer as described above and the sleeve comprises polyphenylene sulfide. The coolant cross-over sleeve comprising polyphenylene sulfide or the polyphenylene sulfide alloy may be disposed within a passage of the coolant cross-over. In such an arrangement the coolant cross-over sleeve may separate the engine coolant from the polymer of the coolant cross-over. Consequently, the coolant cross-over sleeve may reduce physical degradation, thermal degradation, and chemical degradation (e.g. hydrolysis) to the polymer of the coolant cross-over by the engine coolant. The coolant cross-over sleeve comprising polyphenylene sulfide or polyphenylene sulfide alloy may comprise any polyphenylene sulfide composition or polyphenylene sulfide alloy composition described herein.

Referring to the Figures for an example of an embodiment of the subject invention, wherein like numerals indicate corresponding parts throughout the several views, an air intake manifold is generally shown at 20. The air intake manifold 20 supplies air to a plurality of cylinders 22 in an engine 24.

As shown in FIG. 1, the engine 24 is an internal combustion V-type configuration. However, it should be appreciated that the subject invention may be practiced with engine 24 configurations other than the V-type configuration shown, such as an inline engine, and is applicable to all fluid cooled engines. As shown, the engine 24 includes an engine block 26, a first engine component, e.g. a first cylinder head 28, and a second engine component, e.g. a second cylinder head 30. It should be appreciated that the first engine component and the second engine component may include elements of an engine other than the first cylinder head 28 and the second cylinder head 30 that transmit fluid therebetween. The air intake manifold 20 is mounted atop the first cylinder head 28 and the second cylinder head 30. The engine 24 is cooled by an engine coolant circulating through a plurality of water jackets (not shown) defined by the engine block 26, the first cylinder head 28, and the second cylinder head 30. The first cylinder head 28 and the second cylinder head 30 each include a coolant inlet 32 for supplying the plurality of water jackets with the engine coolant. The engine coolant may include a water coolant, a glycol based coolant (antifreeze), or some other coolant suitable for cooling the engine 24.

The air intake manifold 20 comprises a body 34, which defines a plurality of runners 36. The plurality of runners 36 directs the air to the cylinders 22 located in the first cylinder head 28 and the second cylinder head 30. Preferably, the body 34 comprises a polymer. A wide variety of polymers are suitable for use to form the body 34. A particularly preferred polymer for the body 34 is a polyamide, more preferably a nylon. Examples of suitable polyamides include, but are not limited to, nylon 6 or nylon 6/6. In the context of the present invention and as described above, it is to be understood the polymer may be a neat, i.e., virgin, uncompounded resin, or the polymer may be an engineered product where the resin is compounded with other components, for example with select additives to improve certain physical properties. Examples of suitable polymers include, but are not limited to, Ultramid® polyamides commercially available from BASF Corporation.

However, it should also be appreciated that the body 34 may alternatively comprise polyphenylene sulfide as described above, a polyphenylene sulfide alloy as described above, or a metal, such as aluminum. As described above, the polyphenylene sulfide may be neat or an engineered product. Further, the polyphenylene sulfide may be filled or unfilled. For example, the body 34 may comprise a composition having a polymer content of 60% by weight of the composition and a content of the filler of 40% by weight of the composition, i.e., the polyphenylene sulfide content without the filler is equal to 50% by weight of the composition.

As described above, the polyphenylene sulfide or the polyphenylene sulfide alloy may be filled or unfilled. Suitable fillers include, but are not limited to, an aluminum hydroxide, an aluminum oxide, an antimony oxide, an aluminum silicate, a barium sulfate, a calcium carbonate, a calcium magnesium carbonate, calcium magnesium aluminum silicate processed mineral fibers, a calcium silicate, a calcium sulfate, carbon blacks, glass beads or hollow spheres, a graphite, an iron oxide, a magnesium hydroxide, a magnesium oxide, a magnesium silicate, a mica, a montmorillonite, a silica, a soapstone, a titanium dioxide, a zeolite, or a zinc oxide. It should be understood that other fillers may also be utilized. The body 34 comprises a composition having a polymer content of from about 30% to about 70% by weight of the polymer composition and a content of the filler of form about 70% to about 30% by weight of the polymer composition.

The polyphenylene sulfide alloy comprises polyphenylene sulfide and at least one other material, such as another polymer including any thermoplastic or thermoset material. Specifically, the polyphenylene sulfide alloy may comprise a polyolefin homopolymer. Alternatively, a copolymer may be used, such as a high density polyethylene, a low density polyethylene, a linear low density polyethylene, a medium density polyethylene, a polypropylene, a styrene, or a styrene butadiene. Any material compatible with polyphenylene sulfide may be used and is not limited to polymers or polyolefins. In such alloys, at least one half (½) of the polymer content is typically polyphenylene sulfide.

A coolant cross-over 38 extends from the body 34. The coolant cross-over 38 includes a housing 40, which defines a first outlet 42, a second outlet 44, and a passage 46. The passage 46 interconnects the first outlet 42 and the second outlet 44 for circulating the engine coolant between the first outlet 42 and the second outlet 44. The coolant cross-over 38 comprises a polymer. A wide variety of polymers are suitable for use in the coolant cross-over 38. A particularly preferred polymer is a polyamide, more preferably a nylon. Examples of suitable nylon include, but are not limited to, nylon 6 or nylon 6/6. Alternatively, the coolant cross-over 38 may be formed from a polyphenylene sulfide, or a polyphenylene sulfide alloy.

As shown in this embodiment, the coolant cross-over 38 further defines a thermostat well 48 in fluid communication with the passage 46 for supplying the engine coolant to the passage 46. The first outlet 42 of the coolant cross-over 38 is in fluid communication with the coolant inlet 32 in the first cylinder head 28 of the engine 24, and the second outlet 44 is in fluid communication with the coolant inlet 32 in the second cylinder head 30 of the engine 24. Accordingly, the flow of the engine coolant enters the passage 46 through the thermostat well 48 and circulates through the passage 46, the first outlet 42 and the second outlet 44, to the first cylinder head 28 and the second cylinder head 30, respectively. It should be understood that the coolant cross-over 38 may be manufactured either with or without the thermostat well 48, and that the scope of the subject invention should not be limited to a coolant cross-over 38 having a thermostat well 48.

The coolant cross-over 38 further defines a plurality of bores 50 disposed adjacent the thermostat well 48. Each of the plurality of bores 50 includes a threaded insert 52 disposed therein for receiving a fastener (not shown) in threaded engagement with the insert 52 to retain a thermostat (not shown) within the thermostat well 48 as is well know in the art. It should be understood that in the alternative, the insert 52 may not includes threads, and the fastener includes a self-taping fastener for cutting threads into the insert 52.

The sleeve 56 is disposed within the passage 46 and separates the engine coolant from the polymer, e.g., a nylon, forming the coolant cross-over 38 to prevent physical degradation, thermal degradation and/or chemical degradation, e.g., hydrolysis, of the polymer by the engine coolant. The sleeve 56 disposed within the passage 46 comprises and is typically formed from polyphenylene sulfide or the polyphenylene sulfide alloy as described above.

The polyphenylene sulfide or the polyphenylene sulfide alloy for the sleeve 56 may be neat or an engineered product. Further, the polyphenylene sulfide may be filled or unfilled. For example, the sleeve 56 may comprise a composition having a polymer content of 60% by weight of the composition and a content of the filler of 40% by weight of the composition, i.e., the polyphenylene sulfide content without the filler is equal to 50% by weight of the composition.

As described above, the polyphenylene sulfide or the polyphenylene sulfide alloy utilized for the sleeve 56 may be filled or unfilled. Suitable fillers include, but are not limited to, an aluminum hydroxide, an aluminum oxide, an antimony oxide, an aluminum silicate, a barium sulfate, a calcium carbonate, a calcium magnesium carbonate, calcium magnesium aluminum silicate processed mineral fibers, a calcium silicate, a calcium sulfate, carbon blacks, glass beads or hollow spheres, a graphite, an iron oxide, a magnesium hydroxide, a magnesium oxide, a magnesium silicate, a mica, a montmorillonite, a silica, a soapstone, a titanium dioxide, a zeolite, or a zinc oxide. It should be understood that other fillers may also be utilized. The sleeve 56 may comprise a composition having a polymer content of from about 30% to about 70% by weight of the polymer composition and a content of the filler of form about 70% to about 30% by weight of the polymer composition.

As described above in relation to the body 34, The polyphenylene sulfide alloy optionally utilized for the sleeve 56 comprises polyphenylene sulfide and at least one other material, such as another polymer including any thermoplastic or thermoset material. Specifically, the polyphenylene sulfide alloy may comprise a polyolefin homopolymer. Alternatively, a copolymer may be used, such as a high density polyethylene, a low density polyethylene, a linear low density polyethylene, a medium density polyethylene, a polypropylene, a styrene, or a styrene butadiene. Any material compatible with polyphenylene sulfide may be used and is not limited to polymers or polyolefins. In such alloys, at least one half (½) of the polymer content is typically polyphenylene sulfide.

The polyphenylene sulfide resists physical degradation, thermal degradation and/or chemical degradation, e.g., hydrolysis, by the engine coolant. It should be understood that when the coolant cross-over 38 comprises polyphenylene sulfide or the polyphenylene sulfide alloy, the coolant cross-over 38 and the sleeve 56 may be independently formed with the sleeve 56 disposed within the passage 46, or alternatively the coolant cross-over 38 and the sleeve 56 may be integrally formed together from polyphenylene sulfide.

Any suitable method may be utilized to dispose the sleeve 56 within the passage 46. One such method includes injection molding the coolant cross-over 38, and then inserting the sleeve 56 into the passage 46. Another such method includes over-molding the sleeve 56, which may include forming the sleeve 56 to include a core material to support the sleeve during an injection molding of the coolant cross-over 38. The core material is typically a tin-bismuth material, but other materials known in the art may also be utilized. The sleeve 56 is then placed in an injection molding apparatus to mold the coolant cross-over 38 onto and about the sleeve 56. The coolant cross-over 38 and the sleeve 56 are then heated to melt the core material from within the sleeve 56. It is also contemplated that the coolant cross-over 38 and the sleeve 56 may be formed simultaneously in the same forming process from two separate materials, such that the sleeve 56 is formed from polyphenylene sulfide or the polyphenylene sulfide alloy, and the coolant cross-over 38 is simultaneously formed from nylon around the sleeve. It should be understood that other methods may be utilized to dispose the sleeve 56 within the coolant cross-over 38.

It is preferred that the body 34 is formed from and comprises nylon and the body 34 and the coolant cross-over 38 are integrally formed together. However, as described above, it is to be understood that the body 34 may be formed from and comprise a metal, in which case the body 34 is metal and the coolant cross-over 38 is nylon.

Alternatively, the body 34 and the coolant cross-over 38 may be separately formed and mechanically connected to or attached together, rather than integrally formed. When separately formed, the body 34 and the coolant cross-over 38 may be chemically bonded together, mechanically attached together, or otherwise attached together by some other method suitable for attaching the polymer coolant cross-over 38 to the body 34. If the body 34 and the coolant cross-over 38 are mechanically attached, the body 34 preferably includes at least one flange 58 extending from the body 34, and the coolant cross-over 38 preferably includes at least one tab 60 extending from the coolant cross-over 38. The at least one tab 60 extends adjacent to the flange 58 in an overlapping relationship.

The air intake manifold 20 further comprises a fastener 54 extending through the flange 58 and the tab 60 for attaching the coolant cross-over 38 to the body 34. The fastener 54 may include a bolt, a screw, or some other similar device. The flange 58 and the tab 60 each define a concentric opening 62 therethrough. The air intake manifold 20 further comprises a compression ring 64 disposed in the opening 62 defined by the flange 58 and the tab 60 for receiving the fastener 54 therein and limiting a compressive force applied by the fastener 54 on the flange 58 and the tab 60. The compression ring 64 thereby prevents an excessive amount of force from being applied to the flange 58 and the tab 60, which may fracture the flange 58 or the tab 60.

If the body 34 and the coolant cross-over 38 are mechanically attached, the air intake manifold 20 may further comprise a detent device for interconnecting the coolant cross-over 38 and the body 34. The detent device includes a pair of fingers 66 extending from the body 34 to a distal end 68. Each of the fingers 66 includes a ridge 70 disposed at the distal end 68 of the fingers 66. The detent device further includes a recess 72 for receiving the fingers 66 therein. The recess 72 includes a pair of slots 74, each slot 74 receiving one of the ridges 70 on the pair of fingers 66 in an interlocking "snap fit" engagement, thereby attaching the coolant cross-over 38 to the body 34. It should be understood that the detent device may be configured in a manner other than specifically described herein.

It should be understood that the mechanical connection connecting the body 34 and the coolant cross-over 38 may include some other suitable mechanical connection known to those in the art, and the scope of the invention should not be limited to the mechanical connections disclosed herein.

The following discussion illustrates aspects of the invention related to its application to a V-type configuration engine having two cylinder heads. One recognizes that such illustration does not limit the invention. Such discussion is presented to illustrate one potential application of the invention. It should be understood that specific features presented within the illustrative example may also be utilized to describe general aspects of the of the air intake manifold, body of the air intake manifold, and/or the coolant cross-over of the air intake manifold.

The invention has been described in an illustrative manner, and it is to be understood that the terminology that has been used is intended to be in the nature of words of description rather than of limitation. Obviously, many modifications and variations of the present invention are possible in light of the above teachings, and the invention may be practiced otherwise than as specifically described.

What is claimed is:

1. An air intake manifold for supplying air to a plurality of cylinders in an engine, said manifold comprising:

a body defining a plurality of runners for directing the air to the cylinders;

a coolant cross-over extending from said body and defining a first outlet and a second outlet with an interior surface defining a passage interconnecting said first outlet and said second outlet for circulating an engine coolant between said first outlet and said second outlet;

said coolant cross-over comprising a polymer; and a sleeve comprising a polyaromatic sulfide and lining at least a portion of said interior surface of said coolant cross-over within said passage of said coolant cross-over for separating the engine coolant and said coolant cross-over to prevent degradation of said polymer of said coolant cross-over by the engine coolant.

2. A manifold as set forth in claim 1 wherein said polyaromatic sulfide comprises polyphenylene sulfide.

3. A manifold as set forth in claim 1 wherein said polymer of said coolant cross-over comprises a nylon.

4. A manifold as set forth in claim 3 wherein said body comprises a nylon.

5. A manifold as set forth in claim 4 wherein said body and said coolant cross-over are integrally formed together.

6. A manifold as set forth in claim 1 wherein said coolant cross-over comprises polyaromatic sulfide.

7. A manifold as set forth in claim 6 wherein said polyaromtic sulfide of said coolant cross-over comprises polyphenylene sulfide.

8. A manifold as set forth in claim 6 wherein said coolant cross-over and said sleeve are integrally formed together.

9. A manifold as set forth in claim 6 wherein said polyphenylene sulfide of said coolant cross-over is in the form of a polyphenylene sulfide alloy.

10. A manifold as set forth in claim 1 wherein said polyaromatic sulfide of said sleeve comprises a polyphenylene sulfide alloy.

11. A manifold as set forth in claim 1 further comprising a mechanical connection interconnecting said body and said coolant cross-over.

12. A manifold as set forth in claim 11 wherein said body includes at least one flange extending therefrom and said coolant cross-over includes at least one tab extending therefrom adjacent to said flange and said manifold further comprises a fastener extending through said flange and said tab for attaching said coolant cross-over to said body.

13. A manifold as set forth in claim 12 wherein said flange and said tab define an opening therethrough and said manifold further comprises a compression ring disposed in said opening defined by said flange and said tab for receiving said fastener therein to limit a compressive force applied by said fastener on said flange and said tab.

14. A manifold as set forth in claim 12 further comprising a detent device for interconnecting said coolant cross-over and said body.

15. A manifold as set forth in claim 1 wherein said coolant cross-over defines a thermostat well in fluid communication with said passage and wherein said first outlet is in fluid communication with a first coolant inlet defined by a first cylinder head of the engine and said second outlet is in fluid communication with a second coolant inlet defined by a second cylinder head of the engine such that the flow of the engine coolant enters said passage through said thermostat well and circulates through said passage to the first coolant inlet in the first cylinder head and the second coolant inlet in the second cylinder head.

16. A manifold as set forth in claim 15 wherein said coolant cross-over defines a plurality of bores disposed adjacent said thermostat well with each bore having an insert disposed therein for receiving a fastener in threaded engagement with said insert to retain a thermostat within said thermostat well.

17. A coolant cross-over for directing a flow of an engine coolant between a first cylinder head and a second cylinder head of an engine, said coolant cross-over comprising:

a housing comprising a nylon and defining a first outlet and a second outlet with an interior surface defining a passage interconnecting said first outlet and said second outlet for circulating the engine coolant between said first outlet and said second outlet; and a sleeve comprising a polyaromatic sulfide and disposed lining at least a portion of said interior surface of said housing within said passage of said coolant cross-over for separating the engine coolant and said coolant cross-over to prevent degradation of said nylon of said coolant cross-over by the engine coolant.

18. A coolant cross-over as set forth in claim 17 wherein said polyaromatic sulfide comprises polyphenylene sulfide.

19. A coolant cross-over as set forth in claim 18 wherein said polyphenylene sulfide of said sleeve is further defined as a polyphenylene sulfide alloy.

20. A coolant cross-over as set forth in claim 19 wherein said coolant cross-over defines a thermostat well in fluid communication with said passage and wherein said first outlet is in fluid communication with a first cylinder head of the engine and said second outlet is in fluid communication with a second cylinder head of the engine such that the flow of the engine coolant enters said passage through said thermostat well and circulates through said passage to the first cylinder head and the second cylinder head.

21. A coolant cross-over as set forth in claim 20 wherein said coolant cross-over defines a plurality of bores disposed adjacent said thermostat well with each bore having an insert disposed therein for receiving a fastener in threaded engagement with said insert to retain a thermostat within said thermostat well.

22. A coolant cross-over for directing a flow of an engine coolant between a first engine component and a second engine component of an engine, said coolant cross-over comprising:

a housing comprising a polyaromatic sulfide and defining a first outlet and a second outlet and a passage interconnecting said first outlet and said second outlet for circulating the engine coolant between said first outlet and said second outlet.

23. A coolant cross-over set forth in claim 22 wherein said polyaromatic sulfide comprises polyphenylene sulfide.

24. A coolant cross-over as set forth in claim 23 wherein said polyphenylene sulfide of said housing is further defined as a polyphenylene sulfide alloy.

25. A coolant cross-over as set forth in claim 24 wherein said coolant cross-over defines a thermostat well in fluid communication with said passage and wherein said first outlet is in fluid communication with said first engine component and said second outlet is in fluid communication with said second engine component such that the flow of the engine coolant enters said passage through said thermostat well and circulates through said passage to the first cylinder head and the second cylinder head.

26. A coolant cross-over as set forth in claim 25 wherein said coolant cross-over defines a plurality of bores disposed adjacent said thermostat well with each bore having an insert disposed therein for receiving a fastener in threaded engagement with said insert to retain a thermostat within said thermostat well.

* * * * *

UNITED STATES PATENT AND TRADEMARK OFFICE

CERTIFICATE OF CORRECTION

PATENT NO. : 8,156,913 B2
APPLICATION NO. : 12/175537
DATED : April 17, 2012
INVENTOR(S) : Scott C. Schlicker et al.

It is certified that error appears in the above-identified patent and that said Letters Patent is hereby corrected as shown below:

Column 11, line 51, after “sulfide” delete “and disposed lining” and insert therein -- and lining --.

Signed and Sealed this
Eighteenth Day of December, 2012

David J. Kappos

David J. Kappos
*Director of the United States Patent and Trademark Office*